US005487482A

United States Patent [19]

Rocheleau

[11] Patent Number: 5,487,482

[45] Date of Patent: Jan. 30, 1996

[54] HANDLED CLOSURE DEVICE

[76] Inventor: Lawrence W. Rocheleau, 101 Coppermill Rd., Wethersfield, Conn. 06109

[21] Appl. No.: 182,638

[22] Filed: Jan. 14, 1994

[51] Int. Cl.[6] ..... B65D 23/12

[52] U.S. Cl. ..... 215/396; 220/759; 220/769; 222/465.1

[58] Field of Search ..... 215/100 A, 100 R, 215/335, 386, 396, 397; 220/759, 769, 758, 759, 769; 222/210, 465.1, 467, 469

[56] References Cited

U.S. PATENT DOCUMENTS

| | | | |
|---|---|---|---|
| 751,009 | 2/1904 | Puterbaugh et al. | 215/100 A X |
| 1,272,238 | 7/1918 | Ellis | 215/100 A |
| 2,139,961 | 12/1938 | Kleid | 215/100 R X |
| 2,711,839 | 6/1955 | Konefes | 215/100 R X |
| 3,307,752 | 3/1967 | Anderson | 215/397 X |
| 4,345,701 | 8/1982 | Walter | 220/758 X |
| 4,456,135 | 6/1984 | Beekes . | |
| 4,666,197 | 5/1987 | Watson et al. . | |
| 4,667,359 | 5/1987 | Polotti . | |
| 4,788,068 | 10/1988 | Kohus | 215/100 A X |
| 4,842,158 | 6/1989 | Reyes, Jr. . | |
| 4,865,208 | 9/1989 | Lax et al. | 215/396 |
| 4,896,913 | 1/1990 | Kennedy . | |
| 4,936,614 | 6/1990 | Russell . | |
| 4,941,579 | 7/1990 | Lee | 215/100 A X |
| 4,982,869 | 1/1991 | Robbins, III . | |
| 5,078,291 | 1/1992 | Gilmour . | |
| 5,328,069 | 7/1994 | Cohanfard | 215/100 R X |

*Primary Examiner*—Jes F. Pascua
*Attorney, Agent, or Firm*—John R. Flanagan

[57] ABSTRACT

A handled closure device includes a closure body, a closure cap and a handle. The closure body has spaced upper and lower portions and defines an interior cavity extending between the upper and lower portions. The interior cavity has an open bottom adapting the closure body to be fitted over and receive an upper portion of a bottle containing a liquid. The handle is attached to and extends both outwardly from and between the upper and lower portions of the closure body. The closure device also includes first interfitting elements defined on the closure cap and the upper portion of the closure body and being adapted to mount the closure cap on the upper portion of the closure body for undergoing rotational movement relative to the closure body between an opened position wherein flow of liquid is permitted from the bottle through the closure device and a closed position wherein flow of liquid is prevented from the bottle through the closure device. The closure device further includes second interfitting elements defined on the closure body and being adapted to removably mount and secure the closure body on the upper portion of the bottle.

14 Claims, 2 Drawing Sheets

FIG. 1
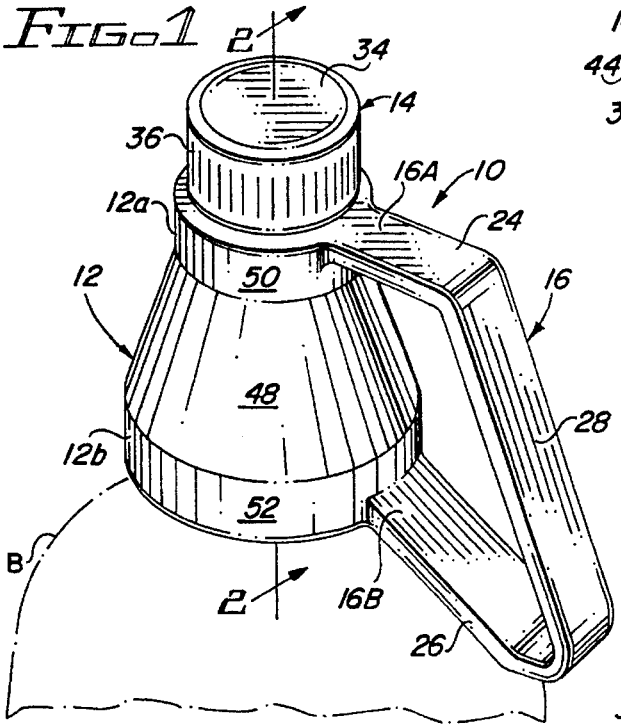
FIG. 3
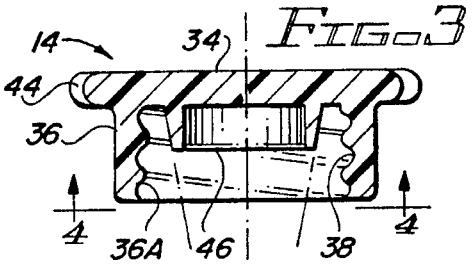
FIG. 4
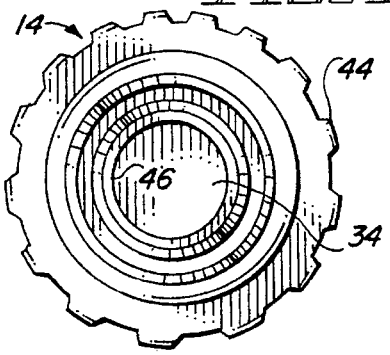
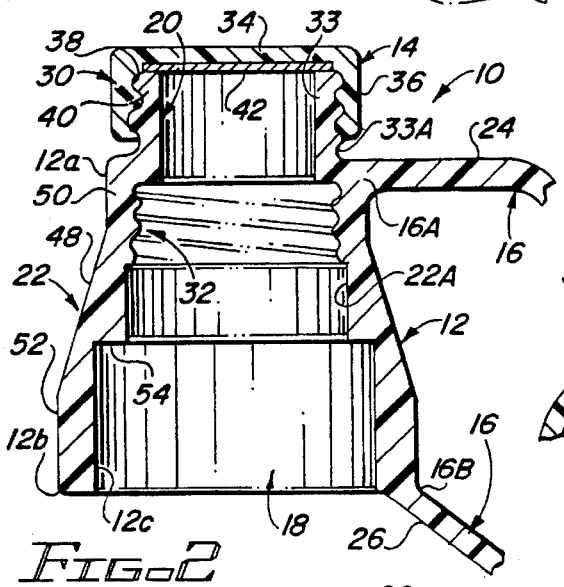
FIG. 2
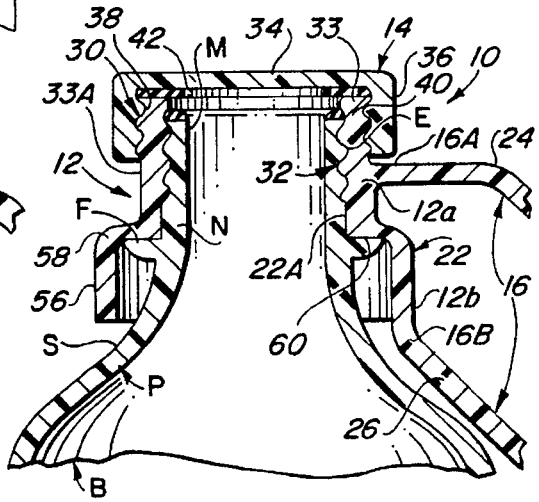
FIG. 5
FIG. 10
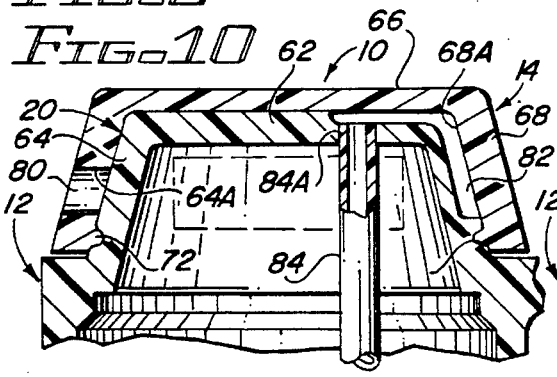
FIG. 9
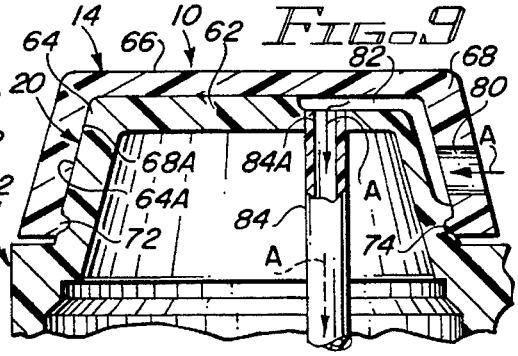

HANDLED CLOSURE DEVICE

BACKGROUND OF THE INVENTION

1. Field of the Invention

The present invention generally relates to bottle holding devices and, more particularly, is concerned with a handled closure device for use with standard size plastic bottles, such as one and two-liter plastic beverage containers or bottles.

2. Description of the Prior Art

The utilization of one- and two-liter plastic bottles as standard beverage containers has gained mass market acceptance in recent years. The resilience and durability of such bottles provides important benefits to the average consumer. A certain difficulty may be experience, however, by some consumers in pouring a beverage satisfactorily from such bottles. For example, people with reduced muscular strength in hands and arms, such as children or adults with arthritis or similar conditions, may experience difficulty in handling these types of bottles and in pouring beverages therefrom without spillage.

A variety of bottle holding devices have been developed providing features for overcoming such difficulties. Representative examples of such devices are disclosed in U.S. patents to Beekes (U.S. Pat. No. 4,456,135), Watson et al (U.S. Pat. No. 4,666,197), Polotti (U.S. Pat. No. 4,667,354), Reyes Jr. (U.S. Pat. No. 4,842,158), Kennedy (U.S. Pat. No. 4,896,913), Russell (U.S. Pat. No. 4,936,614), Robbins III (U.S. Pat. No. 4,982,869) and Gilmour (U.S. Pat. No. 5,078,291).

Most of the above cited devices are designed particularly for use with one- and two-liter plastic bottles. The Robbins III device may be utilized with a wider range of container sizes holding various solid substances as well as a variety of liquids. The Gilmour device is principally for use with a much larger plastic bottle typically supplying bottled water for water dispensers.

The Gilmour device provides a cap feature having handle components attached directly thereto, being attachable together above the cap. The Beekes and Russell devices each basically provide a top annular feature attachable to the neck of a bottle and a specific type of handle attached to the top feature and extending downwardly therefrom for pouring liquid from the bottle.

Each of the other aforecited devices provides a top annular feature attachable to the neck of a bottle and one or more lower annular band structures for holding the body of a bottle. Also, each of the these other devices has a particular type of handle being attached between the top annular features and lower annular band or bands providing a pouring capability for the device.

Several of these devices seem complex in design and construction and therefore costly in production. Such devices include the Beekes, Polotti, Reyes Jr., and Robbins III devices. Additionally, such complexity in design of these devices tends to make use thereof rather cumbersome and inefficient for many people. Further, the Watson, Kennedy and Russell devices seem somewhat awkward to use due to the extended length of the particular handles thereof.

Consequently, a need still exists for a bottle handling device which substantially eliminates the drawbacks of the prior art without introducing other drawbacks in their place.

SUMMARY OF THE INVENTION

The present invention provides a handled closure device designed to satisfy the aforementioned needs. The handled closure device of the present invention provides expanded capabilities not available in the prior art bottle handling devices.

One capability is the simplicity in design and construction of the handled closure device for inexpensive production thereof and for ease in use by both children and adults, including those with limited muscular strength. A second capability is the easy installation and removal of the attachment feature of the device with respect to a bottle, thereby promoting the long life of the device. A third capability is the manner in which the device is securely tightened to the threaded portion of the bottle so as to give the device and bottle the feel of a one-piece assembly with the weight of the bottle being adequately leveraged by the handle of the device for pouring liquid therefrom without spillage.

Accordingly, the present invention is directed to a handled closure device which includes a closure body, a closure cap and a handle. The closure body has spaced upper and lower portions and defines an interior cavity extending between the upper and lower portions. The interior cavity of the closure body has an open bottom adapting the closure body to be fitted over and receive an upper portion of a bottle containing a liquid. The closure cap fits on the upper portion of the closure body. The handle disposed on the exterior of the closure body is attached to and extends between the upper and lower portions of the closure body.

The handled closure device also includes means in the form of first interfitting elements defined on the closure cap and the upper portion of the closure body. The first interfitting elements are adapted to mount the closure cap on the upper portion of the closure body for undergoing rotational movement by the user turning the closure cap relative to the closure body between an opened position wherein flow of liquid is permitted from the bottle through the closure device and a closed position wherein flow of liquid is prevented from the bottle through the closure device.

In a first embodiment of the closure device, the first interfitting elements includes a series of internal screw threads defined on an interior surface of a cylindrical sidewall portion of the closure cap and a series of external screw threads defined on an exterior surface of a cylindrical wall portion of an upper annular head of the closure body. The series of external screw threads are threadably engaged with the series of internal screw threads to permit rotation of the closure cap by the user between the opened and closed positions relative to an open top on the closure body.

In a second embodiment of the closure device, the first interfitting elements includes an annular groove defined in an exterior surface of an annular sidewall portion of the upper annular head of the closure body and an annular rib defined on an interior surface of an annular sidewall portion of the closure cap. The annular rib is received in the annular groove to permit rotation of the closure cap by the user between the opened and closed positions relative to the upper annular head of the closure body.

Also, in the second embodiment of the closure device, the closure cap and upper annular head of the closure body have respective apertures formed therein. The apertures are aligned with one another when the closure cap is disposed at the opened position relative to the upper annular head of the closure body and are displaced from one another when the closure cap is disposed at the closed position relative to the upper annular head of the closure body. Further, the closure cap and the upper annular head of the closure body have respective venting passages formed therein. The venting passages are aligned with one another when the closure cap is disposed at the opened position and are displaced from one another when the closure cap is disposed at the closed position relative to the upper annular head of the closure body.

The handled closure device further includes means in the form of second interfitting elements defined on the closure body. In both first and second embodiments of the closure device, the second interfitting elements is a series of internal screw threads defined on an interior surface of the closure body. The series of internal screw threads are adapted to be removably and rotatably threaded by the user with the series of external screw threads on the upper portion of the bottle to securely mount the closure device on the bottle.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a first embodiment of a handled closure device of the present invention, wherein a closure cap of the device is removable from a closure body thereof.

FIG. 2 is an enlarged fragmentary axial sectional view of a first embodiment of the handled closure device, taken along line 2—2 of FIG. 1.

FIG. 3 is an enlarged sectional view of a modified form of the closure cap of the handled closure device.

FIG. 4 is a bottom plan view of the modified form of the closure cap, taken along line 4—4 of FIG. 3.

FIG. 5 is an enlarged fragmentary axial sectional view of another handled closure device having a closure body modified in shape from that of the handled closure device of FIGS. 1 and 2.

FIG. 9 is an axial sectional view of the non-removable closure cap taken along line 9—9 of FIG. 6, showing the non-removable closure cap when in the opened position also being in a venting relationship with the closure body.

FIG. 10 is an axial sectional view of the non-removable closure cap taken along line 10—10 of FIG. 7, showing the non-removable closure cap when in the closed position also being in a non-venting relationship with the closure body.

DETAILED DESCRIPTION OF THE INVENTION

Figure 6:
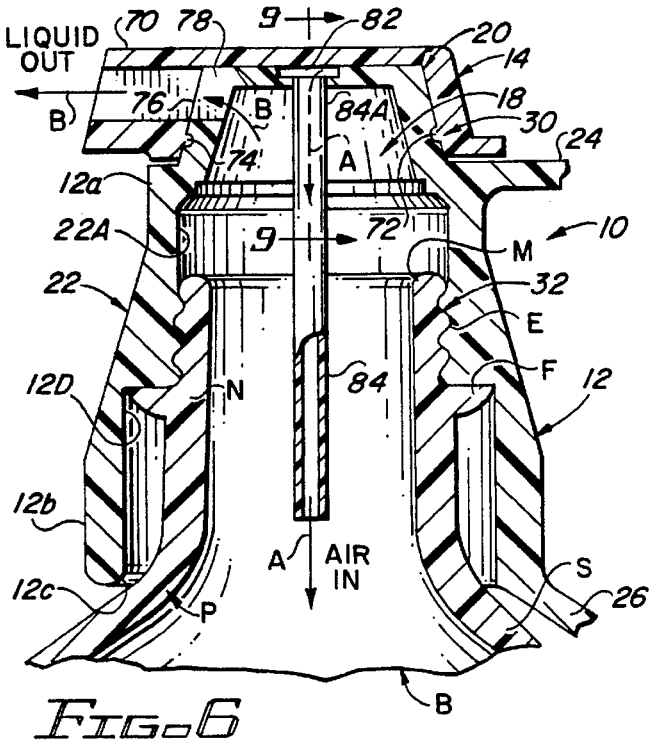
FIG. 6 is a fragmentary axial sectional view of a second embodiment of the handled closure device of the present invention, wherein a non-removable closure cap of the device is shown in an opened pouring position relative to the closure body thereof.

Referring to the drawings, and particularly to FIGS. 1, 2 and 5 and FIGS. 6 and 8, there is respectively illustrated first and second embodiments of a handled closure device, generally designated 10, constructed in accordance with the principles of the present invention. The handled closure device 10 is adapted to be fitted over an upper portion P of a bottle B, such as seen in FIGS. 5 and 6, for containing a liquid, such as a beverage. The upper portion P of the bottle B typically includes an elongated tubular neck N extending upwardly from an annular upper shoulder S of the bottle B. The neck N of the bottle B typically has a top open mouth M through which the liquid is poured from the bottle B, an annular flange F attached about and extending outwardly from the neck N and being spaced below the top mouth M, and a series of external screw threads E defined about the exterior of the neck N between the top mouth M and the annular flange F.

As best seen respectively in FIGS. 2 and 6, the handled closure device 10 of both first and second embodiments basically includes a closure body 12, a closure cap 14 and a handle 16. The closure body 12 of the closure device 10 has a generally annular shape with an interior cavity 18 defined therein extending between spaced upper and lower end portions 12A, 12B of the closure body 12. The interior cavity 18 of the closure body 12 has an open bottom 12C adapting the closure body 12 to be fitted over and receive the upper neck N of the bottle B. Also, the closure body 12 has an upper annular head 20 and a lower annular skirt 22. The closure cap 14 of the closure device 10 fits on the upper annular head 20 of the closure body 12.

As seen in FIGS. 1, 2 and 6, the handle 16 of both first and second embodiments of the closure device 10 is a rigid structure being disposed along one side of the exterior of the closure body 12. The handle 16 is rigidly attached at respective opposite ends 16A, 16B to the upper and lower portions 12A, 12B of the closure body 12. More particularly, the handle 16 has a generally U-shaped configuration and includes an upper leg 24 attached to and extending outwardly from the upper end portion 12A of the closure body 12, a lower leg 26 attached to and extending outwardly and downwardly from the lower end portion 12B of the closure body 12, and a middle leg 28 extending outwardly and downwardly between and rigidly connected to the upper and lower legs 24, 26.

The handled closure device 10 also includes means in the form of first interfitting elements 30 defined on the closure cap 14 and the upper annular head 20 of the closure body 12. The first interfitting elements 30 are adapted to mount the closure cap 14 on the upper annular head 20 of the closure body 12 to permit the closure cap 14 to undergo rotational movement by a user turning the closure cap 14 relative to the closure body 12 between an opened position wherein flow of liquid is permitted from the bottle B through the closure device 10 and a closed position wherein flow of liquid is prevented from the bottle B through the closure device 10.

The handled closure device 10 further includes means in the form of second interfitting elements 32 defined on an interior surface 12D of the closure body 12. The second interfitting elements 32 are adapted to removably mount and secure the closure device 10 on the upper neck N of the bottle B. In both the first and second embodiments of the closure device 10, the second interfitting elements 32 are a series of internal screw threads 32 defined on the interior surface 12D of the closure body 12. As seen in FIGS. 2 and 5, the series of internal screw threads 32 are spaced above the lower portion 12B and open bottom 12C of the interior cavity 18 of the closure body 12, being located adjacent to the series of external screw threads 40 defined the upper portion 12A of the closure body 12 and thus closer to the series of external screw threads 40 on the upper portion 12A of the closure body 12 than to the lower portion 12B of the closure body 12. The series of internal screw threads 32 are adapted to be removably and rotatably threaded with the series of external screw threads E on the upper neck N of the bottle B to securely mount the closure device 10 on the bottle B by the user placing the closure body 12 over the neck N of the bottle B and then turning the closure body 12 relative to the bottle B.

Referring to FIGS. 1 and 2, in a first embodiment of the closure device 10, the upper annular head 20 of the closure body 12 is formed by a cylindrical wall portion 33. The closure cap 14 has a circular top end wall portion 34 and a cylindrical sidewall portion 36 attached to and extending downwardly from the top end wall portion 34. Thus, as seen in FIGS. 2 and 5, the circular top end wall portion 34 of the closure cap 14 extends across and closes an upper end of the cylindrical sidewall portion 36 thereof. The first interfitting elements 30 includes a series of internal screw threads 38 defined on an interior surface 36A of the cylindrical sidewall portion 36 of the closure cap 14 and a series of external screw threads 40 defined on an exterior surface 33A of the cylindrical wall portion 33 of the upper annular head 20 of the closure body 12. The series of internal screw threads 38 are threadably engaged with the series of external screw threads 40 to permit rotation of the closure cap 14 by the user relative to the closure body 12 between the opened position (not shown) wherein the closure cap 14 is completely removed from the closure body 12 exposing an open top 12E of the closure body 12 and the closed position, as seen in FIGS. 1, 2 and 5, wherein the closure cap 14 and a disk-shaped seal gasket 42 contained therein sealably close the open top 12E of the closure body 12.

It should be pointed out here that, in the one form of the first embodiment of the closure device 10 shown in FIGS. 1 and 2, the outside diameter of the series of external screw threads E on the bottle neck N are the same as the outside diameter of the series of external screw threads 40 on the upper annular head 20 of the closure body 12. Thus, the cap which accompanied the original beverage bottle B can also serve and function as the closure cap 14 of the closure device 10.

Additionally, as shown in FIGS. 3 and 4, the closure cap 14 can also have an annular knurled outer rim 44 formed integrally with and extending radially outwardly from the periphery of the top end wall portion 34 of the closure cap 14. This closure cap 14 further has an inner annular tapered seal ring 46 which seals with the inside of the top open mouth M on the bottle neck N.

In the one form of the first embodiment of the closure device 10 shown in FIGS. 1 and 2, the lower annular skirt 22 includes a middle frusto-conical wall portion 48 integrally attached to, and truncated at its opposite ends by, an upper cylindrical wall portion 50 and a lower cylindrical wall portion 52. The cylindrical wall portion 33 of the upper annular head 20 is integrally connected with and extends upwardly from the upper cylindrical wall portion 50 of the lower annular skirt 22. The series of internal screw threads 32 of the second interfitting elements are defined on an interior surface 22A of the upper cylindrical wall portion 50 of the lower annular skirt 22. Also, the lower annular skirt 22 has an internal downwardly-facing annular shoulder 54 defined on the interior surface 22A thereof which seats upon the external annular flange F on the upper neck N of the bottle B once the closure device 10 has been fully threadably installed on the upper neck N of the bottle B.

Referring to FIG. 5, in a modified form of the first embodiment of the closure device 10, the lower annular skirt 22 of the closure body 12 includes a lower cylindrical wall portion 56 having an inside diameter being greater than an inside diameter of the cylindrical wall portion 33 of the upper annular head 20 of the closure body 12. The lower annular skirt 22 of the closure body 12 also includes an upper radial wall portion 58 extending between and interconnecting a lower end of the cylindrical wall portion 33 of the upper annular head 20 and an upper end of the lower cylindrical wall portion 56 of the lower annular skirt 22. The upper radial wall portion 58 defines an internal downwardly-facing annular shoulder 60 for seating upon the annular flange F on the upper neck N of the bottle B.

Referring to the second embodiment of the closure device 10 shown in FIGS. 6–10, the upper annular head 20 of the closure body 12 includes an upper end wall portion 62 and an annular sidewall portion 64 attached to and extending downwardly from the upper end wall portion 62. The closure cap 14 includes an upper end wall portion 66 and an annular sidewall portion 68 attached to and extending downwardly from said upper end wall portion. The closure cap 14 also includes a pouring spout 70 attached to and extending outwardly from the annular sidewall portion 68 of the closure cap 14. As best seen in FIGS. 9 and 10, except for the presence of the pouring spout 70, the closure cap 14 has a configuration substantially the same as that of the upper annular head 20 of the closure body 12.

Also, in the second embodiment of the closure device 10, the first interfitting elements 30 include an annular groove 72 defined in an exterior surface 64A of the annular sidewall portion 64 of the upper annular head 20 of the closure body 12 and an annular rib 74 defined on an interior surface 68A of an annular sidewall portion 68 of the closure cap 14. The annular rib 74 is received in the annular groove 72 so as to permit rotation of the closure cap 14 by a user relative to the upper annular head 20 of the closure body between the opened position shown in FIG. 6 and the closed position shown in FIG. 7.

Figure 7:
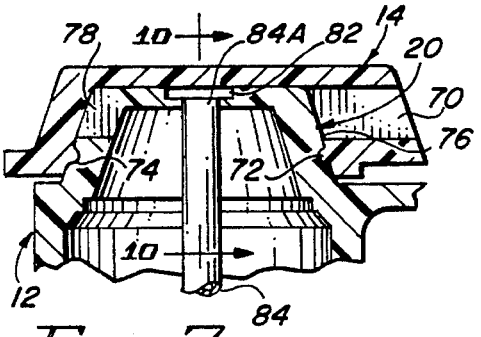
FIG. 7 is a view similar to that of FIG. 6, but only showing an upper portion of the closure body with the non-removable closure cap in a closed non-pouring position relative thereto.
Figure 8:
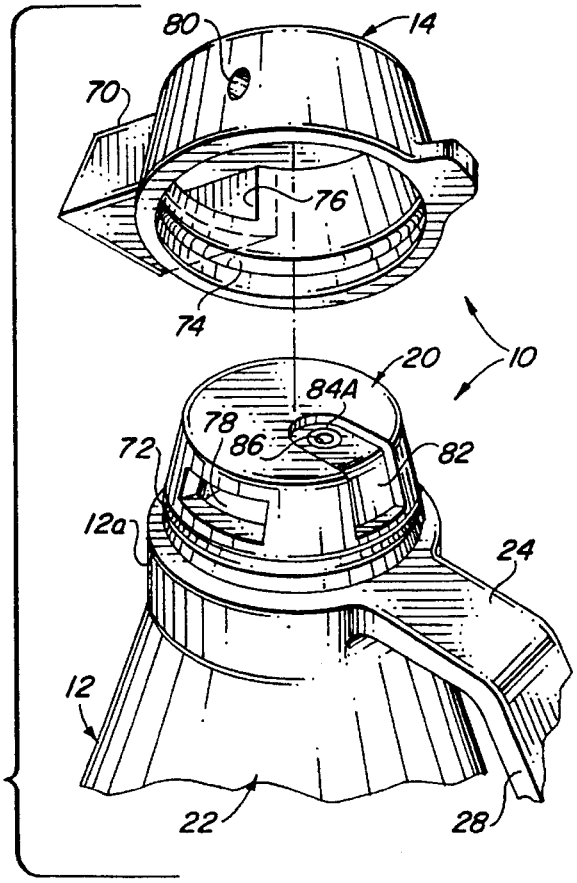
FIG. 8 is a fragmentary exploded perspective view of the second embodiment of the handled closure device of FIG. 6.

Also, in the second embodiment of the closure device 10 as seen in FIGS. 6–8, the annular sidewall portion 68 of the closure cap 14 and the annular sidewall portion 64 of the upper annular head 20 of the closure body 12 have respective apertures 76, 78 formed therein. As seen in FIG. 6, the apertures 76, 78 are aligned with one another when the closure cap 14 is disposed at the opened position relative to the upper annular head 20 of the closure body 12. On the other hand, as seen in FIG. 7, the apertures 76, 78 are misaligned and displaced from one another when the closure cap 14 is disposed at the closed position relative to the upper annular head 20 of the closure body 12. As seen in FIG. 6, the pouring spout 70, being attached to and extending outwardly from the annular sidewall portion 68 of the closure cap 14, is provided in communication with the aperture 76 in the closure cap 14.

Further, referring to FIGS. 8–10, the annular sidewall portion 74 of the closure cap 14 and the upper end wall portion 62 and annular sidewall portion 64 of the upper annular head 20 of the closure body 12 have respective venting passages 80, 82 formed therein. As seen in FIG. 9, the venting passages 80, 82 are aligned with one another when the closure cap 14 is disposed at the opened position relative to the upper annular head 20 of the closure body 12. On the other hand, as seen in FIG. 10, the venting passages 80, 82 are misaligned and displaced from one another when the closure cap 14 is disposed at the closed position relative to the upper annular head 20 of the closure body 12.

Furthermore, in the second embodiment of the closure device 10 shown in FIGS. 6–10, an elongated hollow vent tube 84 is provided for communication with the venting passages 80, 82 in the upper annular head 20 of the closure body 12 and in the closure cap 14. The vent tube 84 is attached to the upper end wall 62 of the upper annular head 20 by having an upper end 84A of the vent tube 84 anchored, such as by being frictionally fitted, within a hole 86 defined through the upper end wall 62 of the upper annular head 20. The vent tube 84 then extends downwardly therefrom within the closure body 12 from the upper annular head 20 of the closure body 12. As best seen in FIGS. 9 and 10, the hole 86 and vent tube 84 extending therein are disposed in communication with the venting passage 82 defined in the upper annular head 20 of the closure body 12. In such arrangement, after rotation of the closure cap 14 from the closed position of FIG. 7 to the opened position of FIG. 6, the vent tube 84 and venting passages 80, 82 thereby provide a pathway (as shown by the arrows A in FIGS. 6 and 9) for flow of air from exteriorly of the closure cap 14 and closure body 12 into the bottle B as liquid is poured from the bottle B (as shown by the arrows B in FIG. 6) through the closure device 10 when the bottle 10 is tilted from a vertical position toward a horizontal position.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A handled closure device for mounting to a bottle having a closure cap, said device comprising:

(a) a closure body having spaced upper and lower portions and defining an interior cavity extending between said upper and lower portions, said interior cavity having an open bottom adapting said closure body to be fitted over and receive an upper portion of a bottle containing a liquid and after a closure cap applied on the upper portion of the bottle is removed therefrom;

(b) first mounting means defined on said upper portion of said closure body for mounting the closure cap to undergo rotational movement relative to said upper portion of said closure body between an opened position wherein the closure cap is removed from said closure body and the flow of the liquid from the bottle through the device is permitted and a closed position wherein the closure cap is secured over and seals with said upper portion of said closure body and the flow of the liquid from the bottle through said device is prevented;

(c) second mounting means defined on said closure body for removably mounting said closure body on the upper portion of the bottle, said second mounting means being spaced above said lower portion of said closure body and said open bottom of said interior cavity therein and adjacent to said first mounting means on said upper portion of said closure body and thus located closer to said first mounting means on said upper portion of said closure body than to said lower portion thereof; and (d) a handle disposed exteriorly of said closure body and being attached to and extending outwardly from said closure body.

2. The device of claim 1 wherein said handle has a generally U-shaped configuration and includes an upper leg attached to and extending outwardly from said upper portion of said closure body, a lower leg attached to and extending outwardly from said lower portion of said closure body, and a middle leg extending between and rigidly interconnecting said upper and lower legs.

3. A handled closure device, comprising:

(a) a closure body having spaced upper and lower portions and defining an interior cavity extending between said upper and lower portions, said interior cavity having an open bottom adapting said closure body to be fitted over and receive an upper portion of a bottle containing a liquid;

(b) a closure cap having a cylindrical sidewall portion and a circular top end wall portion attached to and extending across and closing an upper end of said sidewall portion;

(c) first mounting means defined on said sidewall portion of said closure cap and said upper portion of said closure body for mounting said closure cap on said upper portion of said closure body to undergo rotational movement relative to said closure body between an opened position wherein said closure cap is removed from said closure body and the flow of the liquid from the bottle through the device is permitted and a closed position wherein said top end wall portion of said closure cap is secured over and seals with said upper portion of said closure body and the flow of the liquid from the bottle through said device is prevented; and (d) second mounting means defined on said closure body for removably mounting said closure body on the upper portion of the bottle, said second mounting means being spaced above said lower portion of said closure body and open bottom of the interior cavity therein and adjacent to said first mounting means on said upper portion of said closure body and thus located closer to said first mounting means on said upper portion of said closure body than to said lower portion thereof; and (e) a handle disposed exteriorly of said closure body and being attached to and extending outwardly from said closure body.

4. The device of claim 1 wherein said closure body has an upper annular head and a lower annular skirt.

5. The device of claim 4 wherein said lower annular skirt includes a frusto-conical wall portion.

6. The device of claim 4 wherein said second mounting means includes a series of internal screw threads defined on an interior surface of said lower annular skirt.

7. The device of claim 6 wherein said lower annular skirt has a downwardly facing annular shoulder defined on said interior surface thereof below said second mounting means, said annular shoulder for seating upon an annular flange on the upper portion of the bottle.

8. The device of claim 4 wherein said upper annular head includes a cylindrical wall portion.

9. The device of claim 8 wherein said first mounting means includes a series of external screw threads defined on an exterior surface of said cylindrical wall portion of said upper annular head.

10. The device of claim 9 wherein said second mounting means includes a series of internal screw threads defined on an interior surface of said cylindrical wall portion of said upper annular head.

11. The device of claim 8 wherein said lower annular skirt includes a lower cylindrical wall portion having an inside diameter being greater than an inside diameter of said cylindrical wall portion of said upper annular head.

12. The device of claim 11 wherein said lower annular skirt also includes an upper radial wall portion disposed below said second mounting means defined on said closure body and extending between and interconnecting a lower end of said cylindrical wall portion of said upper annular head and an upper end of said lower cylindrical wall portion of said lower annular skirt, said upper radial wall defining a downwardly facing annular shoulder for seating upon an annular flange on the upper portion of the bottle.

13. The device of claim 3 wherein said first mounting means includes:

a series of internal screw threads defined on an interior surface of said cylindrical sidewall portion of said closure cap; and a series of external screw threads defined on an exterior surface of said cylindrical wall portion of said upper annular head of said closure body and being threadably engaged with said series of internal screw threads to permit rotation of said closure cap between said opened and closed positions relative to an open top on said upper annular head of said closure body.

14. The device of claim 3 wherein said closure cap also includes a knurled outer rim attached about said upper end wall portion of said closure cap.

* * * * *